US005810118A

United States Patent [19]

Blain

[11] Patent Number: 5,810,118

[45] Date of Patent: Sep. 22, 1998

[54] ELEVATOR POSITION LOCK

[76] Inventor: Roy W. Blain, Boellinger Hofe, 74078 Heilbronn, Germany

[21] Appl. No.: 697,695

[22] Filed: Aug. 28, 1996

Related U.S. Application Data

[60] Provisional application No. 60/002,670, Aug. 30, 1995.

[51] Int. Cl.[6] ..... B66B 9/04

[52] U.S. Cl. ..... 187/272; 187/357

[58] Field of Search ..... 187/272, 275, 187/284, 357, 360, 351, 356

[56] References Cited

U.S. PATENT DOCUMENTS 4,041,845 8/1977 Mean et al. ..... 187/272

OTHER PUBLICATIONS

Cover Letter to Jackson and Chovanes from Roy W. Blain.

Feb. 96/Elevator World, pp. 50–52; 76, 78.

Brochure Systema Sicherheit bei Druckabfall, p. 2 (see cover letter for English explanation).

*Primary Examiner*—Kenneth Noland

*Attorney, Agent, or Firm*—Eugene Chovanes

[57] ABSTRACT

A clamping system for selectively keeping a hydraulic elevator stationary at a selected floor level.

18 Claims, 2 Drawing Sheets

ELEVATOR POSITION LOCK

STATEMENT OF INVENTION

This invention relates to the fixing of the position of an elevator stopped at floor level, so that in the process of loading or unloading, the elevator does not shift up or down more than a narrowly limited distance.

BRIEF DESCRIPTION OF PRIOR ART

A hydraulic elevator for example stopped at floor level, when subject to loading, tends to move downwards under the load. The amount of movement depends upon the size of load and the volume and compressibility of the oil in the cylinder pressure line and can be in excess of 25 mm. (1"). The usual re-leveling system applied to elevators does not prevent the elevator from sometimes moving down excessively by the addition of a load but only reacts after the excessive movement has taken place, to restore the elevator to its previous position, level with the floor, after the inconvenience or dangerous situation has occurred. Another known solution is to lower the elevator onto mechanical stops which have engaged as the elevator was slightly above floor level. The disadvantage of this system is that before the elevator can descend, it must first ascend so that the mechanical stops can be disengaged.

SUMMARY OF THE INVENTION

It is an object of the invention to restrict within narrow limits the vertical movement of an elevator in either direction when at floor level during loading or unloading by employing a hydraulic clamping device combined with an electro-hydraulic leveling system while still allowing the elevator to descend normally, upon command, without previously having to ascend or otherwise build up pressure in the main cylinder.

BRIEF DESCRIPTION OF THE DRAWINGS

FIG. 1A is an elevational view and FIG. 1B is a plan view.

FIG. 2A is an elevational view and FIG. 2B is a plan view.

DESCRIPTION OF PRESENT INVENTION

Figure 1A:
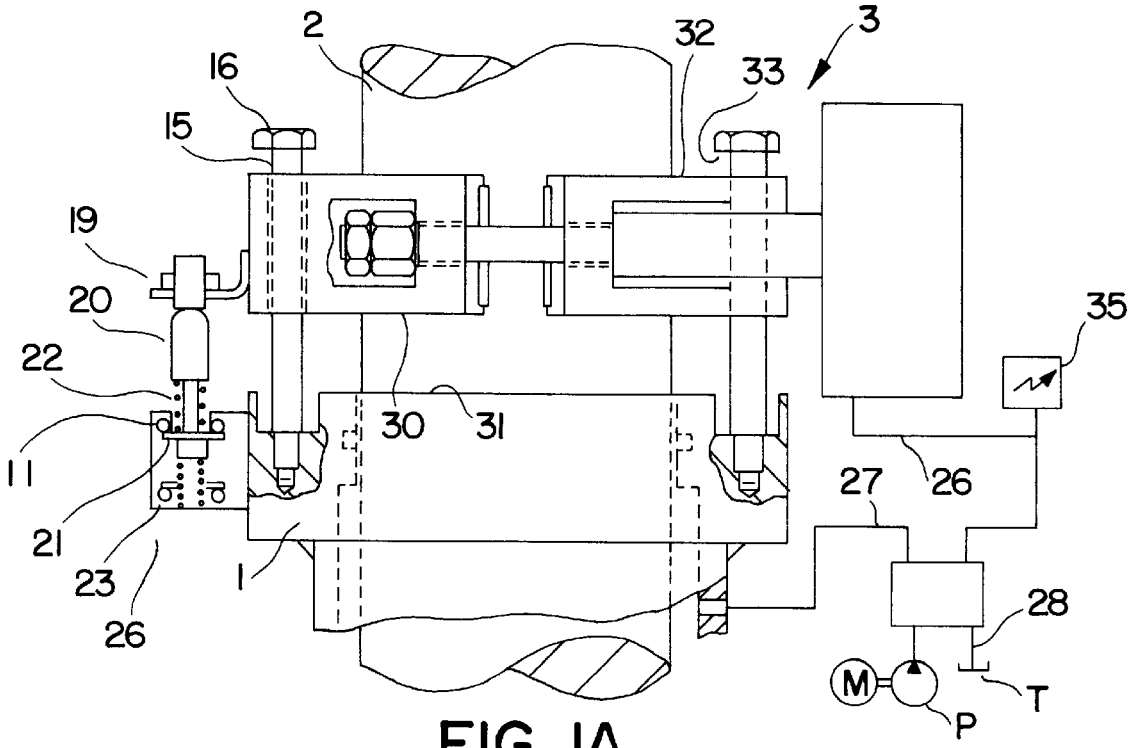
FIGS. 1A and 1B are schematic diagrams illustrating a hydraulic elevator, the cylinder head of which is fitted with a hydraulically operated ram clamp surrounding the main ram and a limit switch arrangement.
Figure 1B:
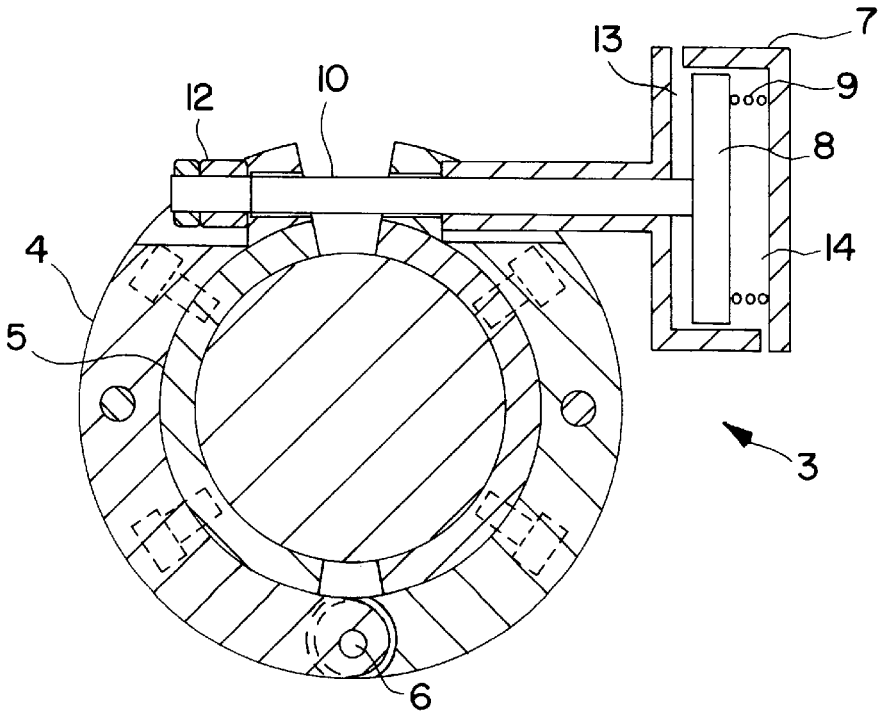

A hydraulic clamp 3 is mounted to the top of an elevator cylinder 1 as shown in FIGS. 1A and 1B. When the elevator reaches the floor level and stops, the stop switch activates the electrical control of the hydraulic clamp 3. A standard type open-close solenoid on the clamp valve block 3 is energized, to allow oil discharging from clamp pump P driven by motor M into the clamp pressure chamber 13 forcing clamp piston 8 to withdraw into its cylinder 7 pulling with it clamp rod 10 and clamp wing 4 by means of rod nut 12. The clamp therefore becomes firmly closed around and attached to the main ram of the elevator, such that the clamp moves with the ram as one unit, as the elevator is being loaded or unloaded.

When the clamp has closed and sufficient pressure built up in the clamp cylinder to assure the required grip on the ram, a pressure switch 35 in the hydraulic clamp line activates the limit switch 25 such that when the contact bridge 21 sits across the switch down contacts 11, an open-close type down solenoid of the clamp valve block is energized and opens to allow oil from the elevator cylinder to pass through cylinder hydraulic line 27 to tank whereupon the ram together with the clamp descend until the switch actuator 19 attached to the clamp pushes the switch button 20 joined with the contact bridge, away from the down contacts, thus de-energizing the down solenoid which closes to prevent further escape of oil from the elevator cylinder, bringing the elevator to a halt. The contact bridge is now between down contacts 11 and up contacts 23 in a neutral position effecting no correcting movement of the elevator.

If a load is now moved into the elevator, due to the compressibility of the oil in the main cylinder, the elevator will descend together with the ram until the clamp surface 30 presses down against the cylinder head surface 31, this contact mechanically preventing any further descent of the elevator.

In descending these few millimeters, for example 3 mm., after the first 2 mm. the switch actuator presses the switch button and contact bridge against up contacts 23–24, 1 mm. ahead of the clamp surface reaching the cylinder head surface. A safety overtravel of the switch button is allowed by the spring 22 so that no damage to the up contacts of the switch can occur, as the switch actuator and button move the final 1 mm.

The bridging of the up contacts energizes the up solenoid of the clamp valve block along with the electric motor M of the pump P causing oil to flow from the pump, along cylinder hydraulic line 27 into the cylinder head causing the elevator to ascend with ram and clamp including the switch actuator pressing against the switch button until the contact bridge lifts away from the switch up contacts, interrupting the electrical up circuit, de-energizing the up solenoid of the clamp valve block. The elevator stops with the contact bridge again in a neutral position between the 'up' and 'down' switch contacts.

If a load is now moved out of the elevator, it will ascend until the upper surface 32 of the clamp comes up against the under surface of the bolt head 16 of the bolt 15 which mechanically prevents any further ascent of the elevator.

In ascending these few millimeters the switch actuator allows the switch button with contact bridge to move upwards under spring pressure such that the contact bridge sits across down contacts 11 thereby energizing the down solenoid of the valve block which opens to allow the elevator to descend to a position where the contact bridge moves away from the down contacts thus de-energizing the down solenoid and bringing the elevator to a stop once again in its neutral position.

Figure 2A:
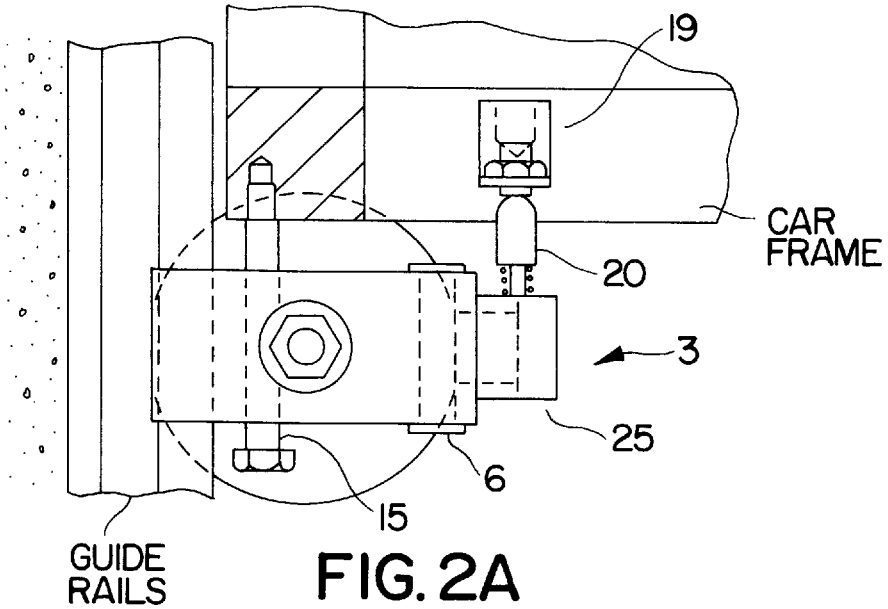
FIGS. 2A and 2B are schematic diagrams illustrating a traction elevator, the car frame of which is fitted with a hydraulically operated ram clamp capable of gripping the guide rails of an elevator incorporating a limit switch arrangement.
Figure 2B:
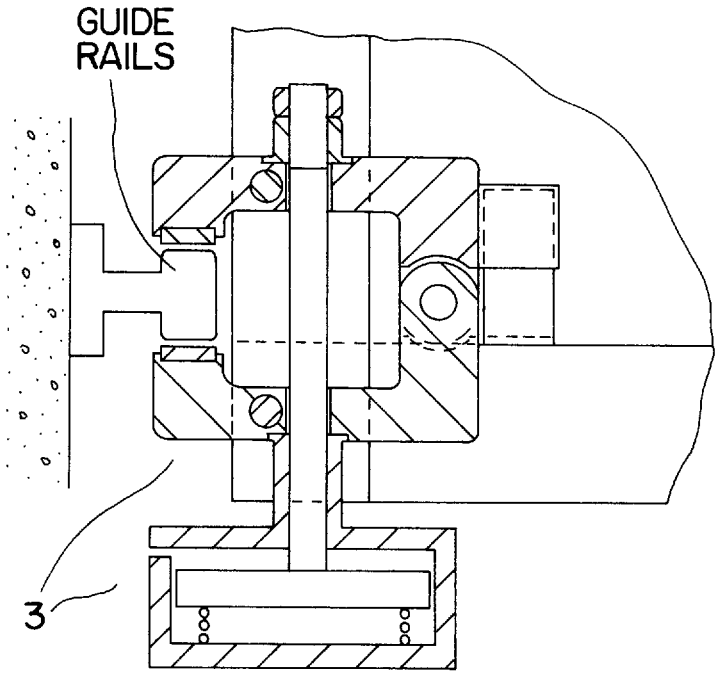

The above system relates to a hydraulic elevator. In the case of a traction elevator, the same basic principle of the invention can be applied with the modification that the clamp assembly is attached to the moveable car frame of the elevator instead of the fixed cylinder head of the hydraulic cylinder and the clamp when closed, grips the fixed guide rails instead of the moveable ram as shown in FIGS. 2A and 2B. The operation of the limit switch system to re-level the traction elevator is in principle the same as described for the hydraulic lift except that the drive for correcting the position of the elevator is through the motor drive to the roping or otherwise through an auxiliary drive for re-leveling as is known to the industry.

The present invention can also be applied as an emergency brake during a system failure which otherwise would result in an uncontrolled movement of the elevator.

I claim:

1. In a hydraulic elevator having a main elevator ram and a cylinder head on a cylinder, a clamping system for keeping the elevator stationary at a floor level comprising:

(a) a hinged clamp passing around the main elevator ram of the elevator;

(b) a clamp cylinder for applying closing pressure to the clamp;

(c) a limit switch and actuator for positioning the elevator ram relative to the cylinder head;

(d) a clamp valve block having solenoid valves; and (e) a motor-pump power unit for providing hydraulic pressure to close the clamp and raise the ram as required;

whereby, when the elevator is stationary at floor level, the clamp around the elevator ram is closed by hydraulic pressure, acting through a short clamp cylinder to grip the ram tightly, the clamp, in its closed position solidly attached to the elevator ram, being limited in its downwards movement relative to the elevator cylinder head by the upper surface of the cylinder head and limited in its upwards movement by the under surface of bolt heads, the bolts being attached firmly to the cylinder head.

2. Apparatus as defined in claim 1 wherein the clamp is operative and closed when the elevator must remain at floor level and open when the elevator is commanded towards another floor.

3. Apparatus as defined in claim 1 wherein a position sensitive switch with separate contacts to command upwards and downwards travel, attached to the elevator cylinder head is operated by an actuator attached to the clamp such that with the elevator at floor level and the clamp operative and closed, a shifting of the ram downwards together with the firmly attached clamp and actuator would operate the switch by closing the up contacts to initiate a corrective upward movement of the main ram by directing oil flow from a pump to the elevator cylinder by way of a solenoid valve until the correction upwards of the ram, causes the up contacts to re-open, de-energizing the up solenoid, the closing of the up contacts of the switch beginning before the undersurface of the clamp has reached the upper surface of the cylinder head and ending when the up contacts open as the ram with clamp and actuator ascend to the neutral position, where neither up nor down contacts are closed.

4. Apparatus as defined in claim 3 wherein the same principle applies should the shifting of the ram be upwards, the difference being that the down contacts of the switch would be closed to command a corrective downward movement of the main ram by energizing a normally closed solenoid valve which opens, directing oil flow from the elevator cylinder until the correction downwards of the ram causes the down contacts to re-open, de-energizing the down solenoid, the actuation of the switch beginning before the upper surface of the clamp has reached the under surface of the bolt head and ending as the down contacts open as the elevator ram with clamp and actuator descend to the neutral position.

5. Apparatus as defined in claim 1 wherein the position sensitive switch is attached to the clamp and the actuator attached to the cylinder head.

6. Apparatus as defined in claim 2 wherein the position sensitive switch is attached to the clamp and the actuator attached to the cylinder head.

7. Apparatus as defined in claim 3 wherein the position sensitive switch is attached to the clamp and the actuator attached to the cylinder head.

8. Apparatus as defined in claim 1 wherein the same principles of positioning the elevator are applied by attaching the clamp mechanism to the car frame of the elevator instead of the cylinder head and by hydraulically clamping the guide rails instead of the main ram.

9. Apparatus as defined in claim 2 wherein the same principles of positioning the elevator are applied by attaching the clamp mechanism to the car frame of the elevator instead of the cylinder head and by hydraulically clamping the guide rails instead of the main ram.

10. Apparatus as defined in claim 3 wherein the same principles of positioning the elevator are applied by attaching the clamp mechanism to the car frame of the elevator instead of the cylinder head and by hydraulically clamping the guide rails instead of the main ram.

11. Apparatus as defined in claim 4 wherein the same principles of positioning the elevator are applied by attaching the clamp mechanism to the car frame of the elevator instead of the cylinder head and by hydraulically clamping the guide rails instead of the main ram.

12. Apparatus as defined in claim 5 wherein the same principles of positioning the elevator are applied by attaching the clamp mechanism to the car frame of the elevator instead of the cylinder head and by hydraulically clamping the guide rails instead of the main ram.

13. Apparatus as defined in claim 5 wherein the position lock system is applied to a traction elevator.

14. Apparatus as defined in claim 6 wherein the position lock system is applied to a traction elevator.

15. Apparatus as defined in claim 7 wherein the position lock system is applied to a traction elevator.

16. Apparatus as defined in claim 1 wherein the steps of closing the clamp through hydraulic pressure and opening them through spring pressure are reversed so that with the electrical control to the clamp de-activated, the clamp is closed under spring pressure and opened for the movement of the elevator to another floor when the clamp electrical control is re-activated and hydraulic pressure applied to the clamp.

17. Apparatus as defined in claim 1 wherein the invention is applied to machines other than elevators, such as hydraulic presses where it is required to maintain the relative position of rams or pistons to their cylinder within narrow limits throughout changing loads or pressures.

18. Apparatus as defined in claim 1 wherein the invention is applied as an emergency brake during a system failure which otherwise would result in an uncontrolled movement of the elevator.

* * * * *